US006039917A

United States Patent [19]

Morando

[11] Patent Number: 6,039,917

[45] Date of Patent: Mar. 21, 2000

[54] JET COLUMN REACTOR PUMP WITH COAXIAL AND/OR LATERAL INTAKE OPENING

[76] Inventor: Jorge A. Morando, 526 Riverview Trail, Cadiz, Ky. 42211

[21] Appl. No.: 09/005,497

[22] Filed: Jan. 12, 1998

Related U.S. Application Data

[63] Continuation-in-part of application No. 08/733,078, Oct. 16, 1996, Pat. No. 5,863,314, which is a continuation-in-part of application No. 08/489,322, Jun. 12, 1995, Pat. No. 5,683,650

[60] Provisional application No. 60/041,146, Mar. 17, 1997.

[51] Int. Cl.[7] ..... C21D 1/62

[52] U.S. Cl. ..... 266/217; 266/233

[58] Field of Search ..... 75/414, 708; 266/200, 266/217, 233, 44

[56] References Cited

U.S. PATENT DOCUMENTS

| | | | |
|---|---|---|---|
| 5,203,910 | 4/1993 | Areaux et al. | 266/200 |
| 5,395,094 | 3/1995 | Areaux | 266/233 |
| 5,683,650 | 11/1997 | Morando | 266/44 |
| 5,863,314 | 1/1999 | Morando | 75/708 |

*Primary Examiner*—Scott Kastler
*Attorney, Agent, or Firm*—Charles W. Chandler

[57] ABSTRACT

Apparatus for moving and degassing molten metal in a conduit by delivering a gas jet into the conduit in the same direction as the metal is moving, so the momentum of the gas jet pushes the metal along its path of motion.

33 Claims, 8 Drawing Sheets

JET COLUMN REACTOR PUMP WITH COAXIAL AND/OR LATERAL INTAKE OPENING

CROSS-REFERENCE TO RELATED APPLICATIONS

This application is a continuation-in-part of application Ser. No. 08/733,078 filed Oct. 16, 1996 for Monolithic Jet Column Reactor Pump, since issued as U.S. Pat. No. 5,863, 314, Jan. 26, 1999, which in turn was a continuation-in-part of U.S. application Ser. No. 08/489,322 filed Jun. 12, 1995 for a Bubble Apparatus for Removing and Diluting Dross in a Steel Treating Bath, and which has since issued as U.S. Pat. No. 5,683,650 on Nov. 4, 1997; and Provisional Patent Application No. 60/041,146, filed Mar. 17, 1997, for Method and Apparatus for Injecting a Gas Into a Bath of Molten Metal.

BACKGROUND OF THE INVENTION

This invention pertains to an improved gas jet operated pump for moving a liquid such as molten metal in a bath of such liquid, and more particularly to such a pump in which a gas jet is introduced along the direction of motion of the metal in a liquid transfer passage where the liquid intake is through openings in the back and side wall of the liquid transfer passage.

In my aforementioned patent applications, I disclosed a pump for moving molten metal between two spaced locations in a molten metal bath by introducing the molten metal axially through the lower inlet end of a conduit, raised by a gas jet momentum which expands to form metal-lifting bubbles and then removed through an upper outlet opening of the conduit.

Other prior art devices introduce the gas radially through the side wall of the metal-lifting passage, perpendicular to the flow of metal. The direction the gas is introduced into the metal-lifting passage affects pump performance. Gas bubbles draw the metal through the bottom inlet opening of the pumping conduit, while the gas being injected to form those bubbles may oppose the metal motion.

SUMMARY OF THE INVENTION

The broad purpose of the present invention is to provide an improved gas jet column operated apparatus for moving a liquid, such as molten, metal either between two spaced locations in a bath of the liquid or in a strong stream out of the bath.

An example of such apparatus includes a ceramic body having an inclined or horizontal internal passage. The gas is introduced as a gas jet into the lower end of the metal-lifting passage in the direction of the rising molten metal.

The momentum of the gas combines with the buoyancy of the bubbles in moving the metal. The high pressure gas momentum can move the metal either upwardly, horizontally or even downwardly.

In another embodiment of the invention, the metal-lifting passage has a convergent/divergent nozzle between the metal intake windows and the upper outlet opening. The convergent/divergent nozzle controls the coalescence of the bubbles rising in the metal-lifting passage. The transfer of momentum of the gas jet generates the flow of metal. The direction of the gas obviates any tendency of the gas jet to block metal flow. Other forms of the invention employ a metal-lifting passage with either a convergent passage, or a divergent passage depending upon the desired flow rate and the head of the liquid.

The principles of the invention can also be used for introducing a gas into a moving stream of a liquid, or for degassing a bath of the liquid.

Still further objects and advantages of the invention will become apparent to those skilled in the art to which invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
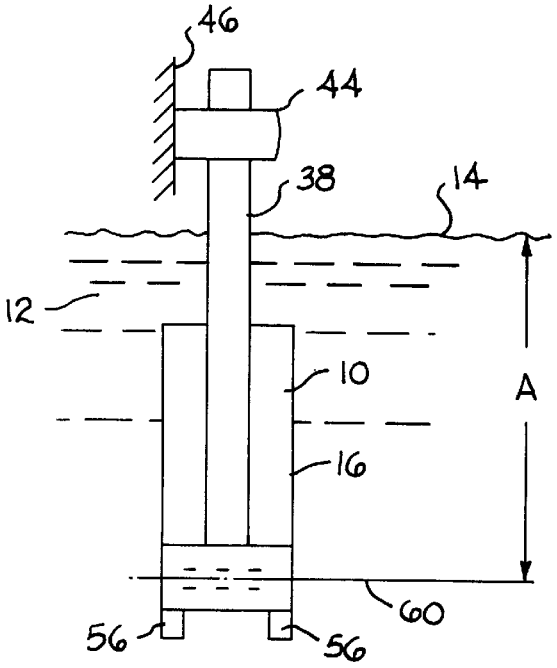
FIG. 1 is an elevational view of a gas jet operated molten metal pump illustrating the preferred embodiment of the invention.
Figure 2:
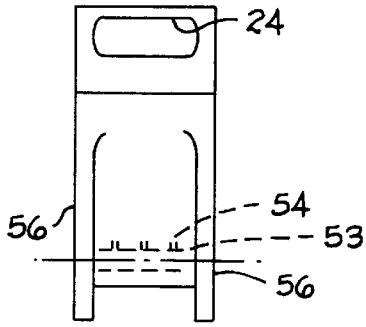
FIG. 2 is a view of the gas jet operated pump from the opposite side of FIG. 1.

Referring to the drawings, FIGS. 1 and 2 illustrate a preferred gas jet column reactor pump apparatus 10 disposed in a bath of molten aluminum 12 having a metal line 14.

Pump 10 comprises a body 16 formed of a ceramic or other suitable material depending upon the particular molten metal in the bath. In a zinc galvanizing bath, the body can be manufactured from graphite, a stainless steel material, or AT-103 or AT-103A, metallic super alloy materials available from Alphatech Inc. of Cadiz, Ky., specifically formulated for resistance to zinc at temperatures up to 1400 degrees Fahrenheit. In Galvalume (aluminum and zinc) or aluminum, the body can be manufactured from any ceramic material resistant to these molten metals or RBSN-AL25, a ceramic material also available from Alphatech Inc. RBSN-AL25 has been proven to be extremely resistant to molten aluminum attack at temperatures up to 1600° F. and capable of withstanding up to 5000 thermal shocks from air to molten aluminum at 1480° F.

Figure 3:
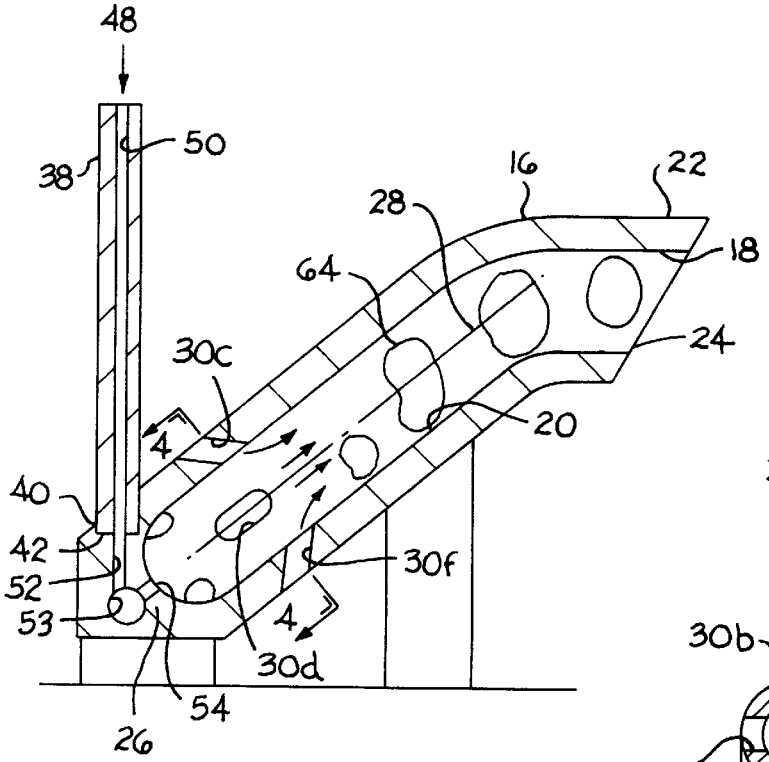
FIG. 3 is an enlarged longitudinal sectional view through the preferred gas jet operated pump.
Figure 4:
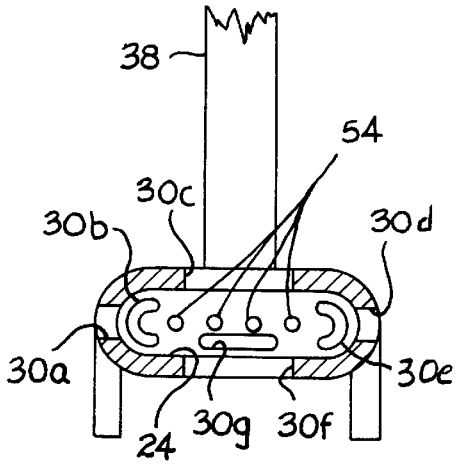
FIG. 4 is a view as seen along lines 4—4 of FIG. 3.

Body 16 has an internal metal-lifting passage 18 which includes an inclined section 20 connected very gradually to a top generally horizontal section 22. The metal-lifting passage has a uniform elliptical cross section along its length as illustrated in FIGS. 2 and 4 at outlet opening 24. The outlet opening is formed at an angle of about 30–45 degrees from the vertical as illustrated in FIG. 3. The metal-lifting passage has a lower blind end 26.

The inclined portion of the metal-lifting passage is formed along an axis 28 which also defines the path of motion of the molten metal as it rises along the metal-lifting passage.

Referring to FIG. 4, seven metal intake windows 30*a*–30*g* are formed in the wall of the metal-lifting passage symmetrically around axis 28. The intake windows have a sufficient size to receive the incoming molten metal which then passes upwardly in the passage and then horizontally out outlet opening 24.

A vertical ceramic gas feeding tube 38 has a lower end 40 received in a recess 42 in the body and attached to the body. The upper end of gas feeding tube 38 is connected to a bracket 44 which in turn is attached to any suitable support 46 adjacent the container holding molten aluminum 12. The length of the gas feeding tube is sufficient to provide body 16 with a gas feeding passage such that its outlet end is a suitable distance, such as 12–30 inches, below metal line 14.

Gas feeding tube 38 has an internal gas passage for receiving a suitable inert gas, such as nitrogen, in the direction of arrow 48, down through a passage 50 which is connected through a short passage 52 in the body to cross passage 53. Passage 53 has several gas outlet openings (nozzles) 54 spaced along axis 60 (FIGS. 1 and 4) and connected to metal-lifting passage 18.

Body 16 is supported on a double pair of leg means 56.

The arrangement is such that the gas is injected as a jet into the metal-lifting passage in the direction of motion of the rising molten metal. The gas jets gradually coalesce to form bubbles such as at 64 which entrap and raise segments of the molten metal.

Thus, the embodiment of FIGS. 1–4 introduces the gas coaxially along the direction of motion of the metal as it rises in the pump. The molten metal is introduced through windows that are in coaxial and lateral positions with respect to the direction of motion of the gas. The transfer to the metal of the gas momentum provides the energy for raising and accelerating the flow of metal.

The pump can be used to re-circulate molten metal in a bath between areas having a difference in temperature, as a pumping device for moving the molten metal from one location in the pot to another for reasons other than changing the temperature differential, such as removing dross by gas dispersion, removing gaseous contaminants, mixing a gas with the molten metal etc.

Figure 5:
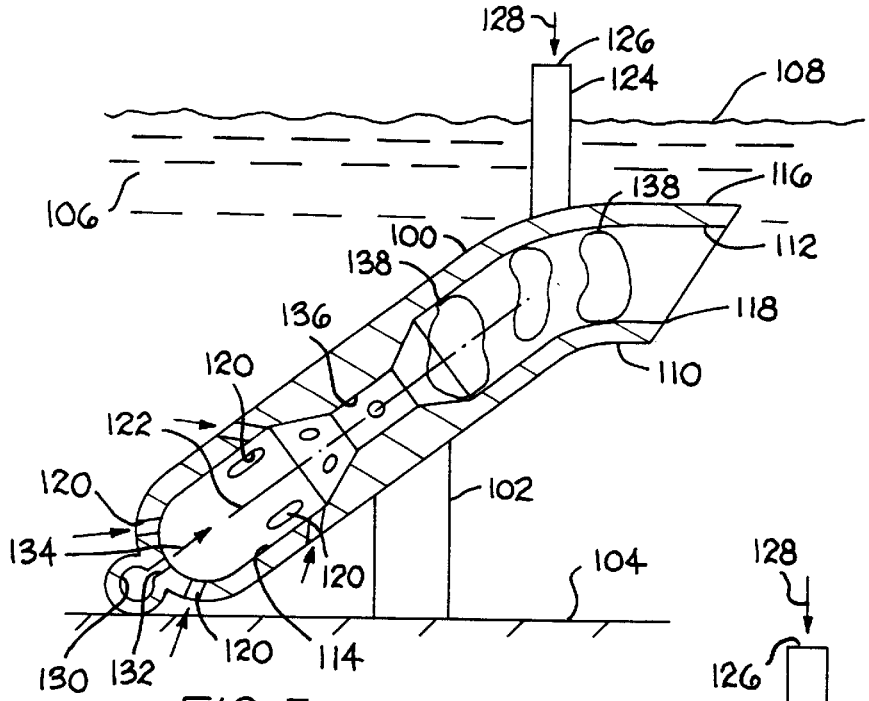
FIG. 5 is a longitudinal sectional view through another embodiment of the invention employing a convergent/divergent nozzle.
Figure 6:
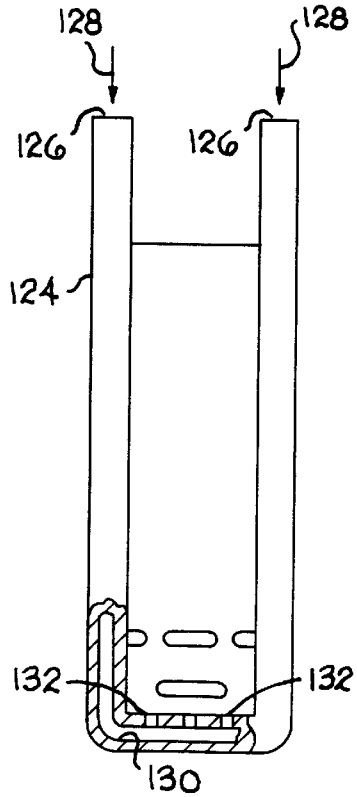
FIG. 6 is a partially fragmentary view seen from the left side of FIG. 5.

FIGS. 5 and 6 illustrate another embodiment of the invention in the form of a pump 100 supported on a refractory, ceramic or graphite pedestal 102 mounted on floor 104 of the pot. The metal, such as molten aluminum 106, is contained in the pot and has a metal level 108. Pump 100 has a tubular body 110 which for illustrative purposes is formed of refractory, ceramic or graphite. The body has an internal metal-lifting passage 112. Passage 112 has an inclined section 114 which merges at its upper end with horizontal section 116 and terminates with outlet opening 118.

As in the embodiment of FIGS. 1 and 4, the wall of the metal-lifting passage has a plurality of rear and lateral metal-intake windows 120 which introduce the molten metal coaxially and/or at an acute angle with respect to the direction 122 of the metal rising in the lower section of the metal-lifting passage.

A U-shaped gas feeding tube 124, also formed of ceramic or graphite, has a pair of upper ends 126 adapted to receive an inert gas in the direction of arrows 128. The gas passes downwardly through a gas passage 130 where it is injected as a jet through a series of bottom gas inlet openings (gas nozzles) 132 into the metal-lifting passage, in the direction of arrow 134 along axis 122.

Figure 7:
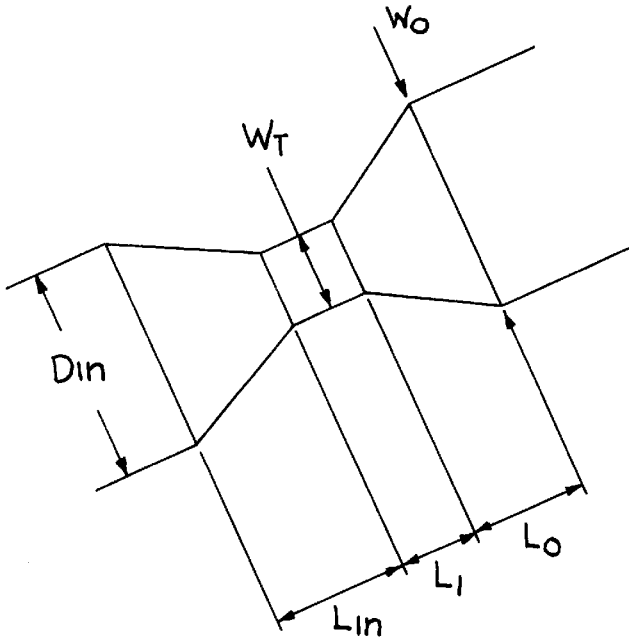
FIG. 7 is an enlarged sectional view of the convergent/divergent nozzle.

Referring to FIG. 7, the metal-lifting passage has a convergent/divergent nozzle 136 having the following approximate ratios:

$$W_T = .90\,W_{in} \text{ to } .60\,W_{in}$$

$$W = \text{Width}$$

$$W_{in} = \frac{3.50 \text{ in}}{4.50 \text{ in}};\ L_{in} = \frac{.60\ W_{in}}{.80\,W_{in}};\ L_1 = \frac{.30\ W_{in}}{.50\ W_{in}};\ \text{and}$$

$$L_0 = \frac{16.0_{in}}{20.0_{in}} \cdot W_0 = W_{in}$$

$$L = \text{Length}$$

The gas jet can be delivered either in a continuous stream or in an intermittent form. In either case, the gas is forcibly diffused into the metal, emerges through nozzles 132 and coalesces in a series of spaced bubbles 138 because of the deceleration of the gas and surface tension. The bubbles rise in the molten aluminum, assisting to entrap sections of aluminum between them, and carry the entrapped sections upwardly toward outlet opening 118.

Figure 8:
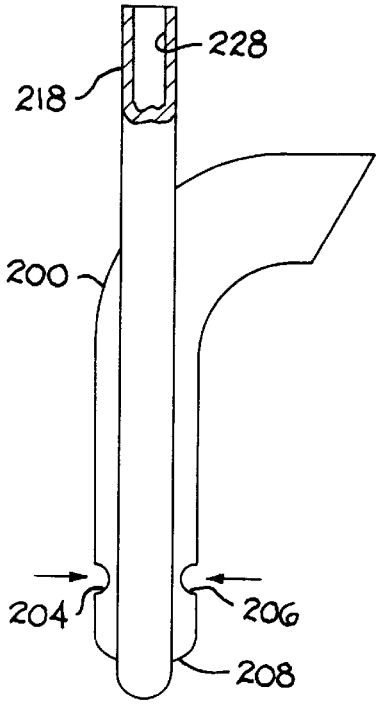
FIG. 8 is an elevational view of another embodiment of the invention incorporating a vertical metal-lifting passage.
Figure 9:
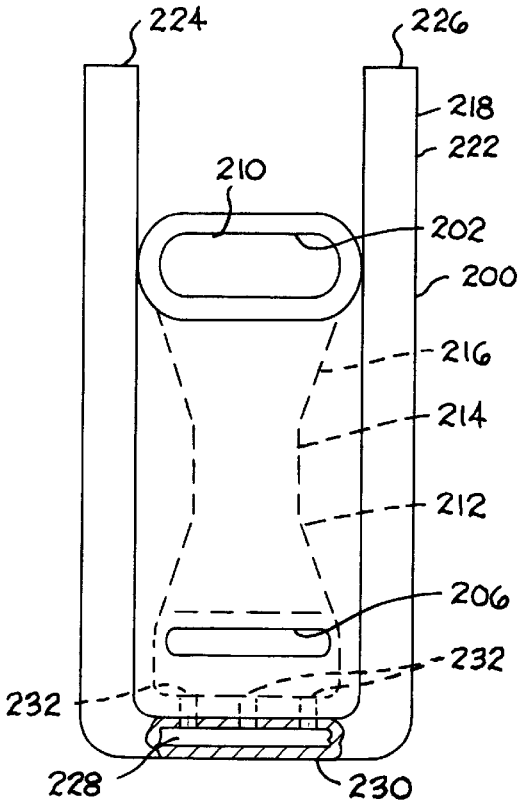
FIG. 9 is a partially fragmentary view as seen from the right side of FIG. 8.

FIG. 8 shows another embodiment of the invention comprising a body 200 formed of graphite, ceramic or other suitable material depending upon the particular metal in the bath. In this embodiment of the invention, body 200 has an internal elliptical passage 202, and a pair of opposed metal-intake windows 204 and 206 formed adjacent its lower blind end 208. The internal passage terminates at its upper end with an outlet opening 210. The major portion of the body is supported in a vertical position as illustrated in FIG. 8.

Passage 202 has an internally convergent nozzle 212 which then forms an intermediate section 214 and then a divergent nozzle 216 formed in accordance with the formula of the embodiment of FIG. 7. This passage functions in the same manner as the embodiment of FIG. 7.

Gas feeding tube 218 has a generally "U" shaped configuration with a pair of vertical legs 220 and 222 having upper inlet ends 224 and 226 for receiving a suitable inert gas such as nitrogen. The gas is delivered downwardly into an internal gas passage 228 which extends from opening 226 to opening 224. A lower horizontal leg 230 is connected to the body beneath the lower end of the metal-lifting passage. Gas passage 228 has three small nozzles 232 for passing the gas from passage 228 into the metal-lifting passage. Although three nozzles 232 are illustrated, a series of small nozzles can be formed to deliver a strong high velocity gas jet to form very small bubbles of gas in the metal-lifting passage.

In this form of the invention, the gas is introduced through the bottom of the metal-lifting passage in the form of a jet and then passes vertically to raise the metal being drawn through intake windows 204 and 206. As the gas passes through the convergent/divergent nozzle, it is initially compressed and then expands to form bubbles so that a combination of the momentum of the gas jets and the buoyancy of the bubbles moves the metal upwardly throughout outlet opening 210.

Figure 10:
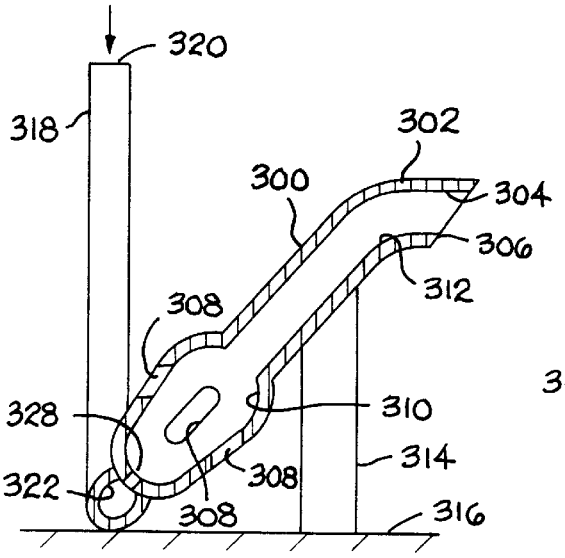
FIG. 10 is a sectional view showing an inclined metal-lifting passage with an internal convergent nozzle.

FIG. 10 illustrates still another embodiment of the invention specifically for maintaining high gas/metal flow velocities for dross or gaseous impurities removal purposes. A jet reactor pump 300 has an elongated ceramic body 302. Body 302 has an internal metal-lifting passage 304. Passage 304 is inclined as illustrated and then merges with a generally horizontal outlet opening 306. The bottom end of passage 304 is closed to metal flow. Windows 308 just above the bottom end of the passage form intake openings for the metal.

The internal metal-lifting passage has a convergent nozzle section 310 which narrows down to an elliptical section 312 which is generally uniform from the convergent nozzle to outlet opening 306, to maintain the high metal/gas flow velocity and forcibly accelerate the metal/gas mixing process. A vertical support leg 314has its upper end attached to the body and its lower end adapted to be mounted on the floor 316 of the metal bath.

A gas feeding tube 318 of graphite or ceramic has an upper inlet end opening 320 for receiving gas into an internal gas passage 322. Tube 318 is generally "U" shaped with a pair of upright legs 324 and 326. The gas passes downwardly through passage 322 to a series of small gas nozzles 328 which connect gas passage 322 to metal-lifting passage 304. Nozzles 328 are aligned along the longitudinal axis 330 of the lower part of the metal-lifting passage.

Figure 11:
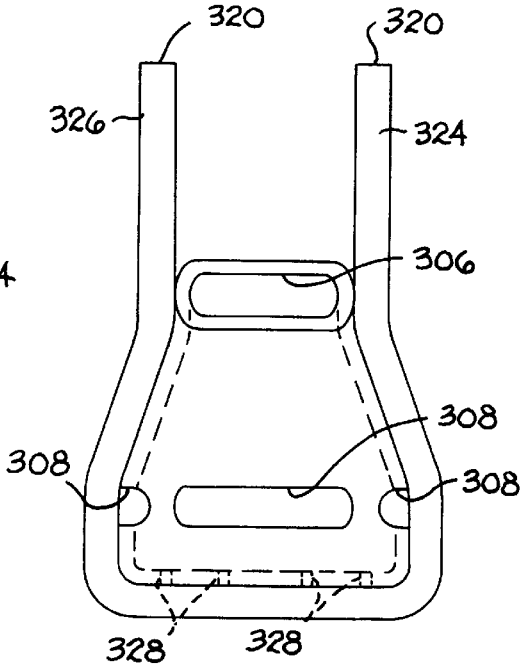
FIG. 11 is a view as seen from the right side of FIG. 10.

Like the embodiment of FIG. 8, the gas is introduced axially through nozzles 328 to the metal-lifting passage so that the energy of the gas pushes the metal upwardly through the convergent nozzle. The metal is received through oblique lateral windows 308, passes upwardly through the convergent nozzle and then out through the upper outlet opening. Since the pumping principle does not depend on the gas bubble buoyancy the metal could also be moved by the gas momentum in either a horizontal or a downward direction. In FIG. 11 the convergent nozzle section has been created by narrowing the pump body 304 frontally rather than laterally.

Figure 12:
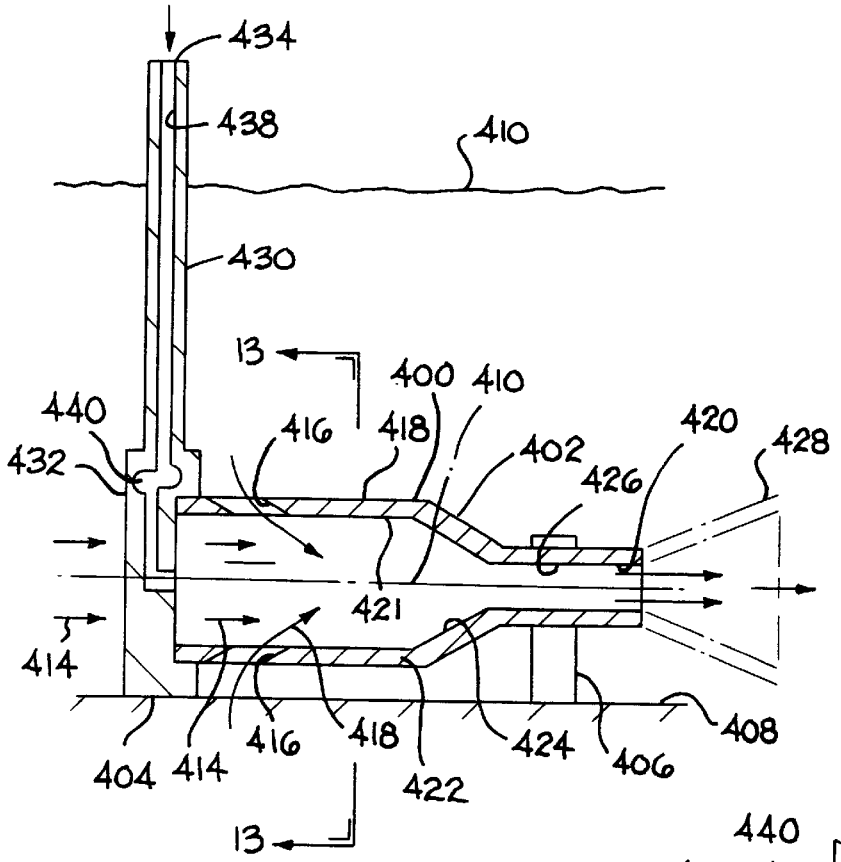
FIG. 12 is another embodiment of the invention employing a convergent nozzle in a horizontal position with lateral and rear inlet openings.
Figure 13:
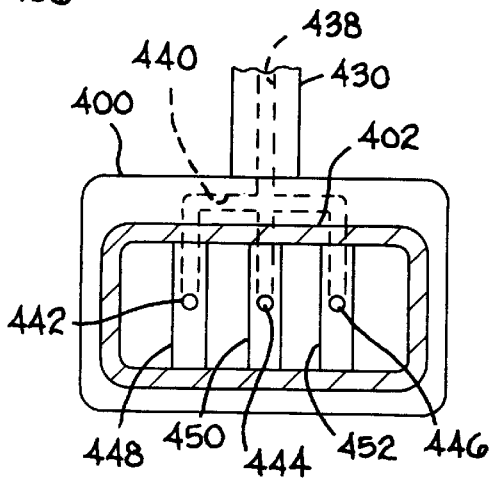
FIG. 13 is a view as seen along lines 13—13 of FIG. 12.
Figure 14:
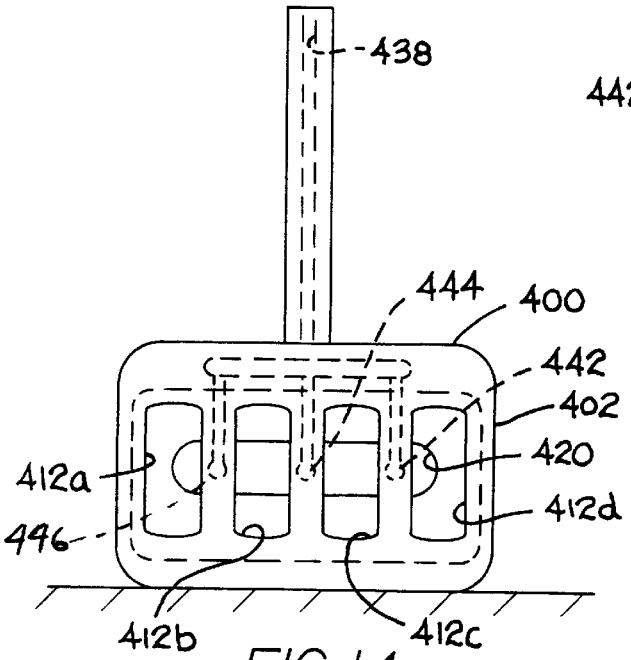
FIG. 14 is a view as seen from the left side of FIG. 12.

Referring to FIGS. 12 to 14, another embodiment of the invention in the form of gas jet reactor pump 400 has a horizontally elongated tubular body 402 supported on the left end, as viewed in FIG. 12, by leg means 404 and 406 on floor 408 of the pot. Body 402 is below the metal level 410 of the pot. The body may be formed of graphite, ceramic or another suitable material depending upon the particular material in the bath. The body has a generally horizontal axis 410 along which the metal flows. The metal is introduced axially through four inlet openings 412*a*, 412*b*, 412*c*, and 412*d* as can be seen in FIG. 14. Each of the openings 412*a*–412*d* are vertically elongated and deliver the metal in the direction of arrows 414 as viewed in FIG. 12.

The body also has a plurality of lateral metal intake openings 416 for receiving metal into the body in the direction of arrows 418. Metal is delivered toward the right as viewed in FIG. 12 toward an elliptical outlet opening 420. The body has an internal passage 421 with a generally elliptical cross section with the inlet portion 422 having a larger diameter which is reduced in a tapered section 424 to form a convergent nozzle which merges into a smaller outlet section 426. Dotted lines 428 indicate an optional divergent outlet opening that may be incorporated.

An upright ceramic gas feeding tube 430 is connected at its lower end to a three nozzle manifold 432. The upper end of gas feeding tube 430 extends above metal line 410. Tube 430 has an upright inlet opening 434 for receiving gas in the direction of arrow 436 through an internal conduit 438. The lower end of conduit 438 terminates in a horizontal passage 440 as is best illustrated in FIG. 13.

Passage 440 is connected with three nozzles 442, 444 and 446 which are disposed in vertical, horizontally-spaced legs 448, 450 and 452, respectively. Gas enters into the moving metal as a jet from nozzles 442, 444 and 446. Legs 448, 450 and 452 are disposed in the horizontal path of motion of the liquid metal as it is received into metal-lifting passage 421 along axis 410.

In this version, both the gas and the liquid enter the metal-lifting passage along the same axial path of motion. In addition, metal is received through lateral openings 416.

Note also that in the embodiment of FIGS. 12 to 14, the metal does not rise but moves horizontally between two spaced positions in the pot. The momentum of the metal is caused by the momentum of the gas jet.

Figure 15:
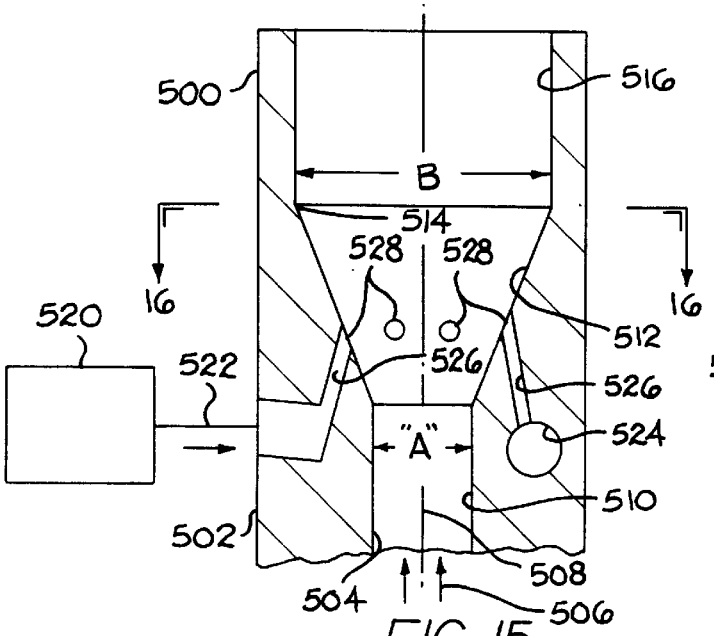
FIG. 15 is a sectional view through a gas jet operated pump for delivering a liquid in a vertical direction using a divergent nozzle.
Figure 16:
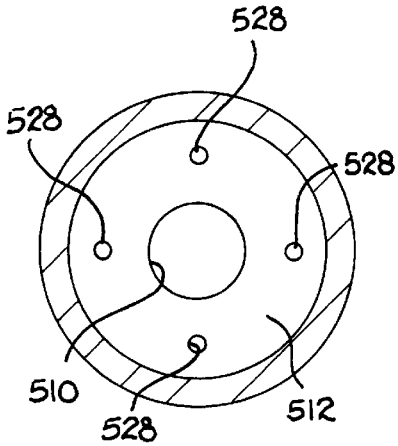
FIG. 16 is a view as seen along lines 16—16 of FIG. 15.

FIGS. 15 and 16 illustrate another form of pump 500 when higher flows and lower output heads are expected. Although this device is described as a pump for moving a liquid, it can also be employed as a device for introducing a gas into a moving liquid, or for de-gassing a liquid such as molten metal.

Pump 500 has an integral body 502 formed of a suitable material with an internal passage 504 for receiving a liquid in the direction of arrows 506 along an axis 508. The pump is oriented so that the liquid is discharged upwardly. However, the pump can be oriented in any direction such as downwardly, horizontally or in any inclined direction.

Passage 504 has a short inlet passage 510 with a circular cross-section, transverse to liquid flow, however the cross-section can be elliptical or have other suitable configurations. Inlet passage 510 has a uniform diameter "A" along its length. Passage 510 forms an inlet to a divergent passage 512 which has a diameter that increases in the direction of liquid flow to an outlet opening 514. Divergent passage 512 is shown with a frusto-conical cross-section, however the cross-section could take other divergent shapes. The outlet end of divergent passage 512 merges with outlet passage 516.

The outlet end of divergent passage 512 has a diameter B that is larger than the inlet end. A suitable pressurized gas source 520 is connected by conduit means 522 to an annular passage 524 in the pump body. Passage 524 has several short gas delivery passage means 526 which terminate in opening means 528 disposed in the wall of divergent passage 512. The gas is delivered through openings 528 in the form of a gas jet at sonic or near sonic velocity to obtain maximum transfer of momentum as the gas rises and to form bubbles which expand to assist in lifting segments of the liquid upwardly toward discharge end 530. The gas can be used either to induce a flow of the liquid through the inlet end, or it can be used for mixing a gas with a liquid in which the liquid flow is induced through other means.

Figure 17:
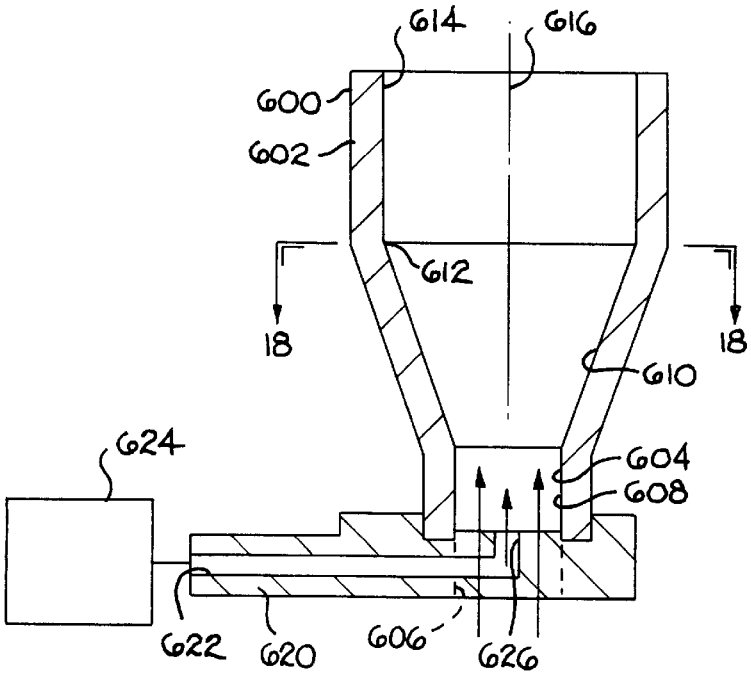
FIG. 17 is a sectional view through another jet operated pump in which the gas is introduced axially through a bottom inlet into the pump transfer passage.
Figure 18:
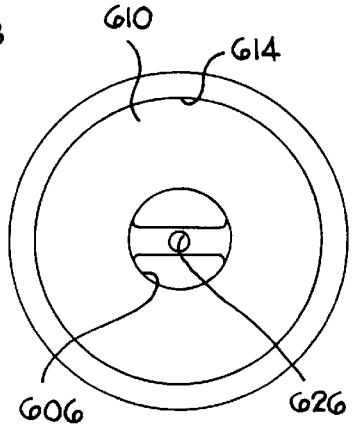
FIG. 18 is a sectional view as seen along lines 18—18 of FIG. 17.

FIGS. 17 and 18 illustrate another embodiment of the invention similar to that of FIGS. 15 and 16 in the form of a pump 600. Pump 600 has a body 602 formed of any suitable material with internal passage means 604 for receiving a flow of a liquid through a bottom inlet opening 606. The internal passage has a cylindrical inlet passage 608 connected to a divergent passage 610 which in turn terminates with a cylindrical end 612. The diameter of the inlet end of the divergent passage is smaller than the diameter of outlet passage 614. Although the inlet and outlet sections are illustrated as being cylindrical, they can also have an elliptical cross-section. Similarly, although divergent passage 610 is illustrated as being frusto-conical, it can also be formed with an elliptical cross-section.

The liquid passes upwardly in a vertical flow pattern along an axis 616 to discharge in an upward direction, however, the pump can be oriented in any other suitable position depending upon the direction the liquid is to be discharged.

A gas delivery section 620 is attached to the bottom of the pump and has an elongated gas delivery passage 622 connected to a source of pressurized gas 624. In this case the gas is delivered as a jet to a bottom gas nozzle 626 along axis 616, parallel with the motion of the moving liquid. This pump can also be used for mixing a gas with a moving liquid or degassing a liquid such as molten metal. The gas is introduced as a jet so that its momentum tends to push the liquid toward the outlet opening. The gas then forms bubbles which expand to assist in lifting sections of the liquid upwardly in combination with the gas momentum.

Figure 19:
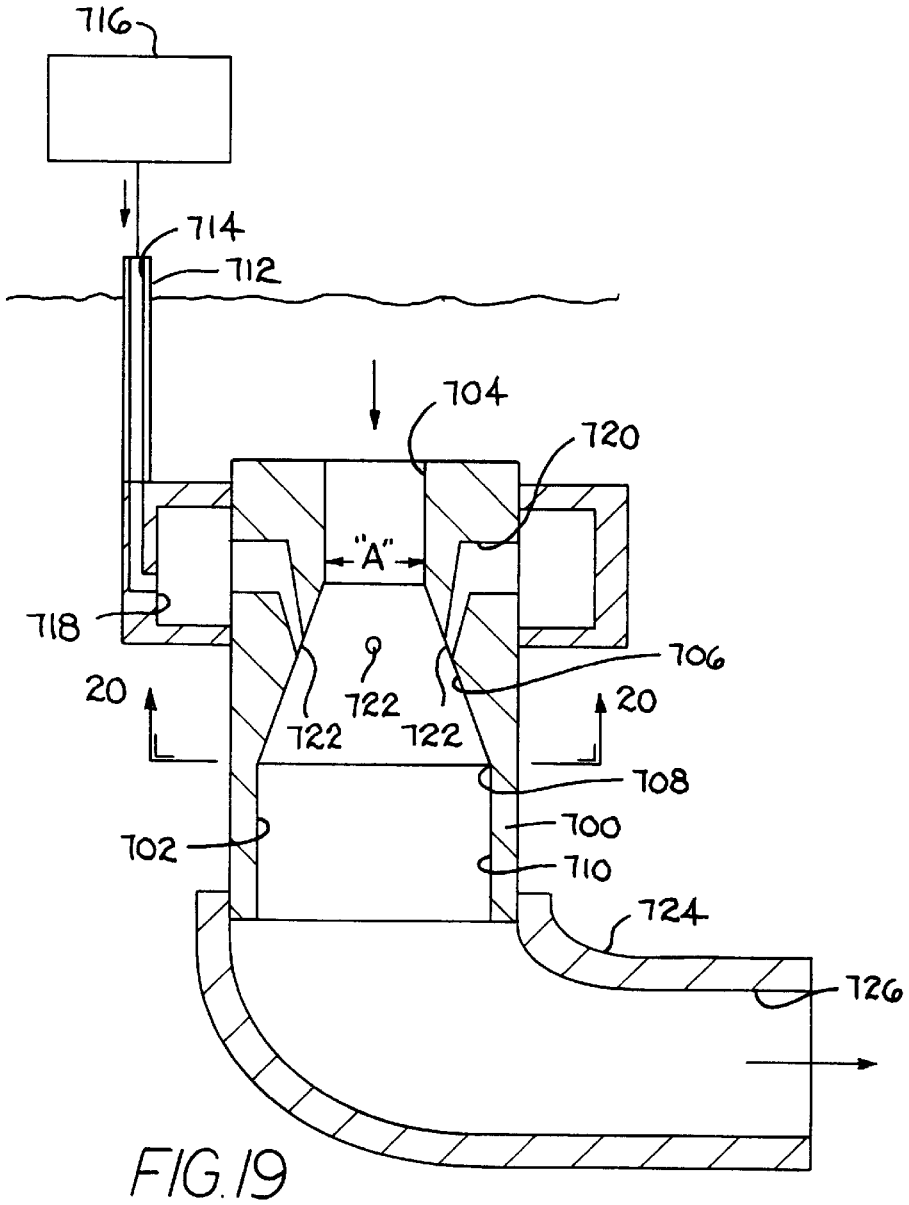
FIG. 19 is a view of another jet operated pump in which the liquid is delivered downwardly through a divergent passage.
Figure 20:
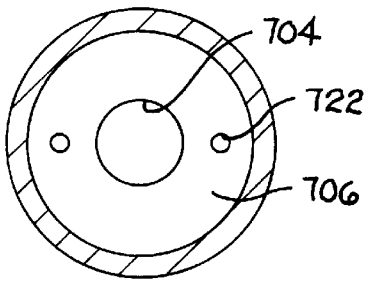
FIG. 20 is a view as seen along lines 20—20 of FIG. 19.

FIGS. 19 and 20 illustrate another embodiment of the invention which is similar to the embodiments of FIGS. 15 and 17 and includes a body 700 having an internal passage 702. Passage 702 has a cylindrical inlet section 704 with a diameter "A" but which also could be made with an elliptical transverse cross-section. The inlet passage then merges with a frusto-conical divergent passage 706 which diverges in the direction of liquid flow, and terminates with an outlet end 708 at a short cylindrical passage 710. Passage 706 functions in a manner similar to that of the embodiment of FIG. 15.

A vertical gas conduit 712 having an internal gas passage 714 is connected to a source of pressurized gas 716. The gas passes from passage 714 to an annular passage 718 which encircles the pump body. Passage 718 passes the gas through short passage means 720 to nozzle means 722. Nozzle means 722 comprise two nozzles 180° apart, however three nozzles 120° apart will also function adequately. The gas is introduced as a jet into the divergent passage 706 so that the momentum of the gas assists in inducing a liquid flow through inlet section 704. Passage 710 is connected to a conduit 724 having an internal passage 726 which delivers the gas/liquid mix in a horizontal direction from the lower end of the pump.

Figure 21:
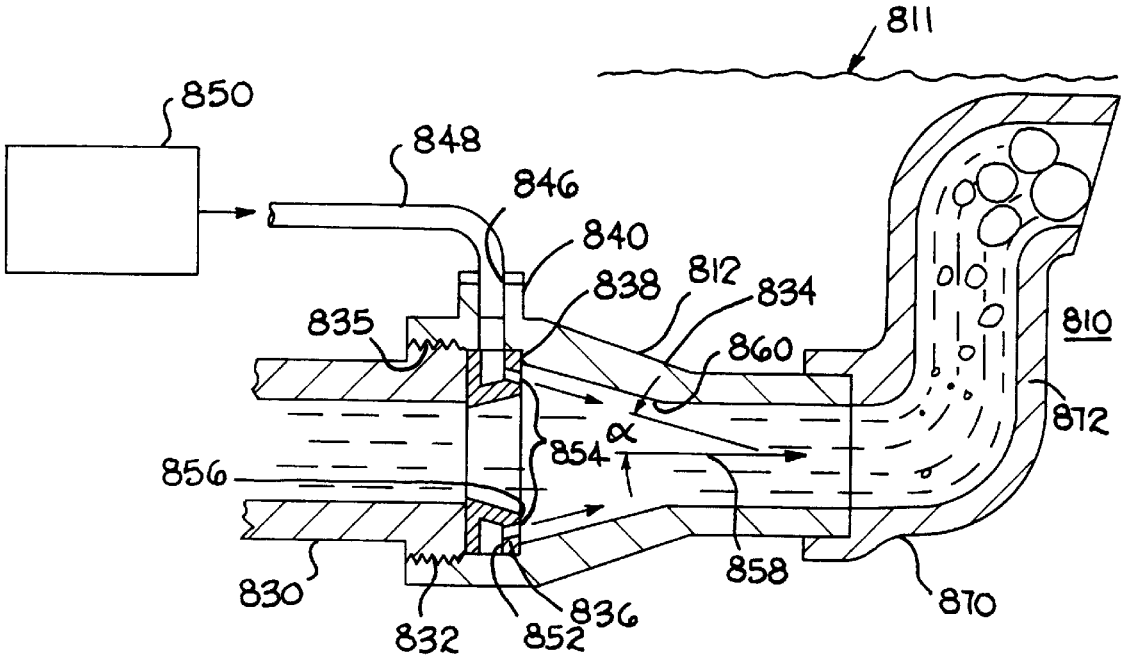
FIG. 21 is a sectional view of an apparatus for introducing the gas jet through a distribution ring.
Figure 22:
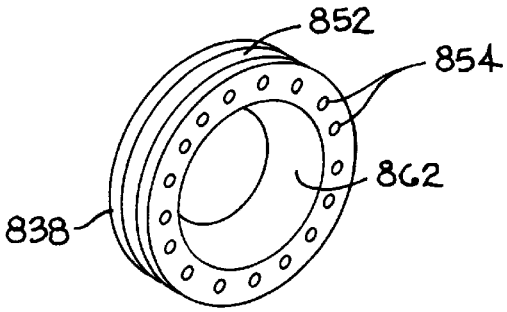
FIG. 22 is an enlarged perspective view of a preferred distribution ring.

FIGS. 21 and 22 illustrate another device for pumping and simultaneously introducing gas into a bath 810 of liquid aluminum having a metal level 811. Pump 812 has a cylindrical inlet conduit 830 with a threaded end 832. A frusto-conical convergent nozzle 834 is internally threaded at 835 and screwed into conduit 830. Nozzle 834 has an annular seat 836.

A distribution ring 838 is mounted between the outer end of conduit 830 and seat 836. Nozzle 834 has a boss 840 with an inlet opening 846 for seating a conduit 848 which delivers a gas, such as nitrogen or chlorine, from a pressurized source 850. Conduit 830 and nozzle 834 may be of any suitable material such as graphite or ceramic. Distribution ring 838 is made of a material that is compatible with the liquid metal and the gas, such as graphite or ceramic.

The distribution ring has an annular slot 852 aligned with gas conduit 848 for receiving a gas into the slot. The distribution ring has an annular series of spaced openings or nozzles 854 which extend from slot 852 through the downstream face 856 of the distribution ring. Nozzles 854 are disposed at an angle $0° \leqq \alpha < 30°$ to deliver the gas in a conical or parallel path at sonic or nearly sonic velocity (whichever is most suited to the application) into the path of metal flow in the direction of arrow 858. This arrangement transfers the gas momentum to the liquid metal thereby increasing the gas dispersion into the metal and improving the pump efficiency.

Convergent nozzle 834 has an internal convergent frusto-conical passage 860 downstream of the distribution ring which also adds to the efficiency of the pump and increases the gas dispersion and the liquid/gas mix velocity.

The distribution ring has an internal frusto-conical passage 862 which is enlarged in the direction of the metal flow to further increase the gas residence time in the liquid. An outlet tube 870 with an internal liquid-lifting passage 872 is attached to the outlet of nozzle 834 to assure gas/liquid contact during the gas coalescence, and in this form to increase the pump flow and gas dispersion capacity.

Figure 23:
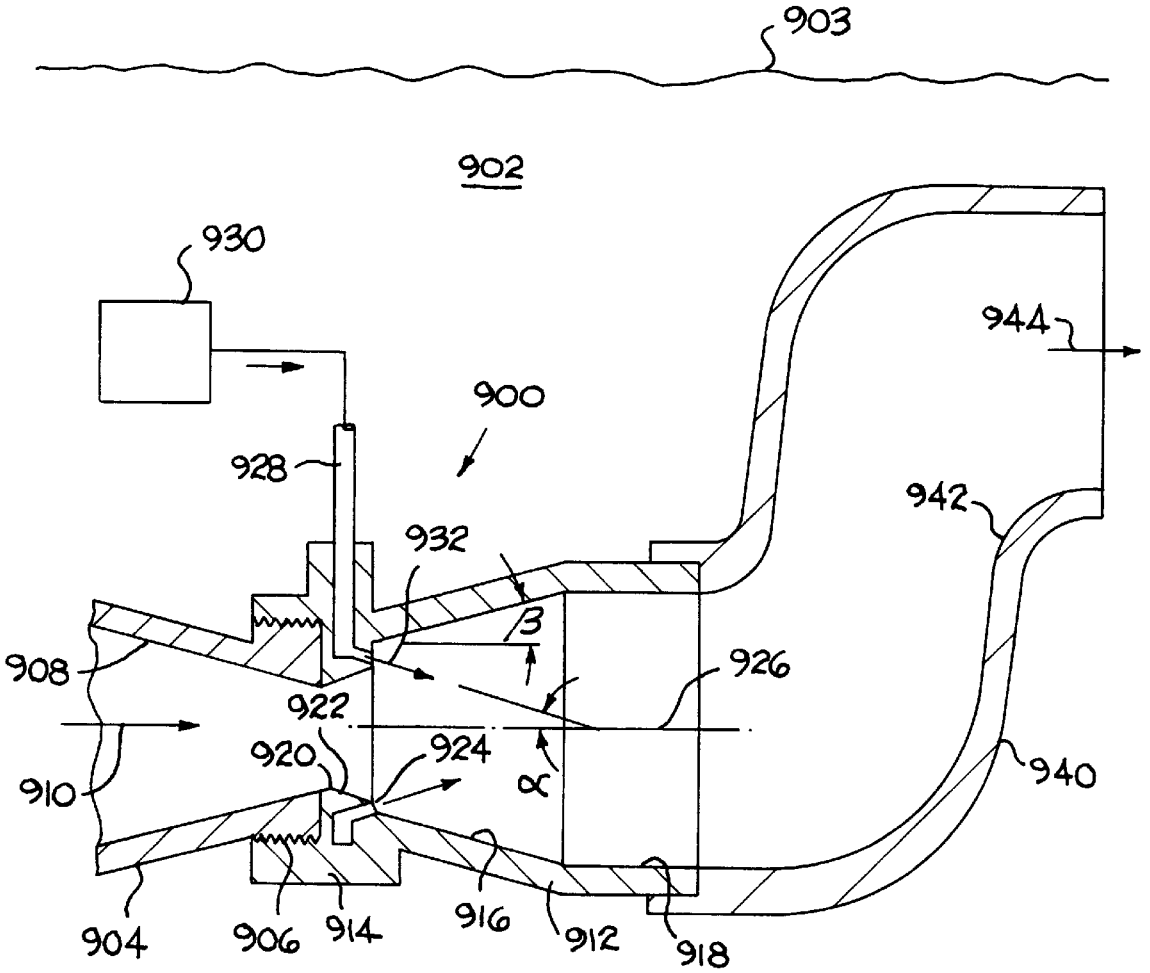
FIG. 23 is a sectional view of another embodiment in which the pump transfer passage diverges from the distribution ring.

FIG. 23 illustrates still another embodiment of the invention in the form of gas jet operated pump 900 operated in a bath 902 of any suitable liquid having a liquid level 903. The pump is similar to the pump of FIGS. 21 and 22, however, it includes an inlet conduit 904 having an externally threaded end 906 with a frusto-conical internal convergent inlet passage 908 for receiving a liquid in the direction of arrow 910.

An outlet conduit 912 has an internally threaded boss 914 threadably connected to the end of inlet conduit 904. Outlet conduit 912 has a frusto-conical internal divergent passage 916 which extends from a throat area 918 that extends from convergent passage 908. The outlet conduit then terminates with a cylindrical discharge section 918. The wall of passage 916 preferably forms an angle $\beta$ with respect to the flow of fluid passing through the inlet toward the outlet. Angle $\beta$ preferably ranges between $0° \leqq \beta < 30°$.

Boss 914 has an integral internal distribution ring section 922 which has an annular array of spaced nozzle means 924 that are disposed about the axis 926 of the frusto-conical passage. The nozzles deliver a gas from a conduit 928 which in turn is supplied by a source 930 of pressurized gas such as nitrogen, or other suitable gas that is to be mixed with the liquid passing through the pump.

The nozzle means deliver the gas in the direction of arrows 932 which are preferably delivered at an angle $\alpha$ which is the angle between the direction of the gas delivery and the flow path of the liquid. The optimum range of angles for $\alpha$ is 7° to 10°. Angles $\alpha$ and $\beta$ are chosen depending upon the nature of the fluid, the pressure, the temperature and volume of fluid being delivered.

A discharge conduit 940 having an internal generally S shaped passage 942 is attached to the cylindrical discharge section 918 to raise the liquid from the pump upwardly and then to discharge it in a generally horizontal direction as indicated by arrow 944. The discharge conduit 940 also assists in increasing the gas flow as the gas forms bubbles that rise in the passage 942 to assist the momentum of the gas in moving the liquid.

The embodiment of FIG. 23 with a divergent flow passage immediately downstream of the gas nozzles is intended to generate a greater gas expansion to increase the liquid flow while reducing the pressure such as in molten aluminum. The divergent passage (diffuser) generates a higher flow capacity for moving the liquid. The embodiment of FIGS. 21 and 22 with the convergent full passage immediately downstream of the gas nozzle is intended to generate a higher pressure head for raising the liquid, or increasing the gas dispersion into the liquid.

Having described my invention, I claim:

1. In a metal treating apparatus having a pot for holding a bath of molten metal, transfer means for moving the molten metal in the pot, including a molten metal-lifting passage having inlet opening means disposed in the molten metal for receiving molten metal into the metal-lifting passage, the metal-lifting passage having an outlet opening in the molten metal for discharging molten metal received in the inlet opening means, the metal-lifting passage having gas-injection openings upstream of the molten metal outlet opening; gas passage means for connecting a source of gas to the gas-injection openings in the form of a gas jet into the metal-lifting passage such that the gas induces a flow of molten metal from the molten metal inlet opening means toward the molten metal outlet opening along an axis of motion, the improvement comprising:

the molten metal inlet opening means comprising a window in the metal-lifting passage disposed coaxially and/or laterally with respect to the path of motion of the gas flowing through the metal-lifting passage;

the gas-injection openings are disposed to introduce a gas jet into the metal-lifting passage along said axis of motion; and the gas injection openings discharge the gas into the metal lifting passage in the direction of metal flow as the gas mixes with the metal.

2. The improvement as defined in claim 1, in which the inlet opening means comprises a plurality of windows disposed in an annular array around the path of motion of gas moving from the gas injection openings.

3. The improvement as defined in claim 1, in which said transfer means includes a tubular element for passing the gas to the gas-injection openings.

4. The improvement as defined in claim 1, including a convergent/divergent nozzle in the metal-lifting passage downstream of the inlet opening means.

5. The improvement as defined in claim 4, in which the metal-lifting passage has a linear upright inlet section, that connects very gradually through a large radii with a generally horizontal outlet section terminating with said outlet opening.

6. The improvement as defined in claim 1, in which the metal-lifting passage has an elliptical cross section.

7. The improvement as defined in claim 1, in which the gas is injected in a direction along the longitudinal axis of the metal-lifting passage.

8. The improvement as defined in claim 1, in which the metal-lifting passage has inlet opening means disposed vertically below the outlet opening.

9. The improvement as defined in claim 1, in which the metal-lifting passage has an enlarged inlet end connected by a convergent nozzle to an outlet section having a smaller diameter than the inlet end.

10. In a metal treating apparatus having a pot for holding a bath of molten metal, transfer means for moving the molten metal in the pot, including a molten metal-moving passage having inlet opening means disposed in the molten metal for receiving molten metal into the metal-moving passage, the metal-moving passage having an outlet opening for discharging molten metal received in the inlet opening means, the metal-moving passage having a gas-injection opening upstream of the molten metal outlet opening; gas passage means for introducing a source of gas from the gas-injection opening in the form of a gas jet into the metal-moving passage in the direction the metal is moving past said gas injection opening toward the molten metal outlet opening such that the momentum of the gas induces a flow of the molten metal from the molten metal inlet opening means toward the molten metal outlet opening.

11. A metal treating apparatus as defined in claim 10, in which the metal-moving passage is substantially horizontal and elongated, and the inlet-opening means is at one end of the metal-moving passage and the outlet opening is at the opposite end of the metal-moving passage.

12. An apparatus as defined in claim 10, including a window in the metal-moving passage disposed laterally with respect to the path of motion of the gas moving through the metal-moving passage.

13. An apparatus as defined in claim 10, in which the metal inlet opening means comprises an opening disposed coaxially with respect to the path of motion of the gas moving through the metal-moving passage.

14. An apparatus as defined in claim 10, in which the metal-moving passage has a divergent section between the inlet opening means and the outlet opening.

15. An apparatus as defined in claim 10, in which the outlet opening has a horizontally elongated elliptical cross section.

16. An apparatus as defined in claim 10, in which the inlet opening means comprises a manifold having a plurality of gas injection nozzles.

17. An apparatus as defined in claim 16, in which the manifold has a plurality of legs disposed in the path of motion of the metal being received into the metal-moving passage, and the nozzle means are disposed in said legs to deliver the gas axially with respect to the metal-moving passage.

18. A pump for moving a liquid comprising:

a body having a liquid inlet port for receiving liquid from a liquid source, and a liquid outlet port, and an internal liquid passage fluidly connecting the liquid inlet port and the liquid outlet port for passing liquid therethrough;

the internal passage having a tapered passage including one end thereof defining said inlet port of a first diameter, and an opposite end defining an outlet port of a second greater diameter downstream of the inlet port;

a source of a gas, and gas jet means disposed in the tapered passage to induce a flow of the liquid from the inlet port toward the outlet port; and the gas jet means discharge the gas into the internal liquid passage in the direction of liquid flow as the gas mixes with the liquid.

19. A pump as defined in claim 18, in which the gas is delivered at an acute angle with respect to the flow of the liquid.

20. A pump as defined in claim 18, in which the gas is introduced axially in the direction of gas flow, adjacent the inlet port to induce liquid flow through the inlet port toward the outlet port.

21. A pump as defined in claim 18, in which the internal passage has a cylindrical cross-section.

22. A pump as defined in claim 18, in which the gas jet means are below the outlet opening.

23. A pump as defined in claim 18, in which the liquid flows through the outlet opening along a generally vertical path of motion.

24. Apparatus for introducing a gas into a moving liquid comprising:

a body having a liquid inlet port for receiving liquid from a liquid source, and a liquid outlet port, and an internal liquid passage fluidly connecting the liquid inlet port and the liquid outlet port for passage liquid therethrough;

the internal passage having a tapered passage including one end thereof defining said inlet port of a first diameter, and an opposite end defining an outlet port of a second lesser diameter downstream of the inlet port;

a source of gas, and gas jet means disposed in the internal passage adjacent the inlet port to induce flow of the liquid from the inlet port toward the outlet port; and the gas jet means discharge the gas into the internal passage in the direction of liquid flow as the gas mixes with the liquid.

25. Apparatus for introducing a gas into a moving liquid stream comprising:

a body means having a tapered internal passage, and an inlet and an outlet for passing a liquid through the tapered internal passage;

a gas distribution means disposed in the body adjacent the tapered passage, the gas distribution means having conduit means connected to a source of a gas, and nozzle means disposed in the body for delivering the gas into the liquid to induce a flow of the liquid through said internal tapered passage; and the gas nozzle means deliver the gas into the internal passage in the direction of liquid flow as the gas mixes with the liquid.

26. Apparatus as defined in claim 25, in which the nozzle means are disposed in an annular array around the path of the moving liquid.

27. Apparatus as defined in claim 25, in which the body means has a tapered inlet passage upstream of the gas distribution means.

28. Apparatus as defined in claim 25, in which the body means has a tapered outlet passage downstream of the gas distribution means.

29. Apparatus as defined in claim 25, in which the body means has an internal passage having an inlet passage which converges toward the annular gas distribution means, and an outlet passage which diverges from the gas distribution means.

30. Apparatus as defined in claim 25, in which the internal passage is adapted to pass a liquid along a flow path along an axis of motion, and the gas distribution means includes nozzles disposed in an annular array around said fluid flow and disposed to deliver the gas at an angle $\alpha$ with respect to said axis of motion.

31. Apparatus as defined in claim 20, in which $\alpha$ the angle between and the direction of gas flow and the direction of fluid flow is in accordance with the following relationship: $0° \leqq \alpha < 30°$.

32. Apparatus as defined in claim 25, in which the body means has a divergent passage immediately downstream of the gas distribution means, the divergent passage having a frusto-conical wall formed with an angle $\alpha$ with respect to the direction of gas flow in accordance with the following relationship: $0° \leqq \alpha < 30°$.

33. An apparatus as defined in claim 25, in which the apparatus is disposed to pass the fluid in a generally horizontal direction, and including an outlet duct connected downstream of the tapered passage, and the outlet duct has a generally S-shaped configuration so as to pass the gas from the pump upwardly and then in a generally horizontal direction.

* * * * *